United States Patent [19]

Curtis

[11] Patent Number: 4,601,125

[45] Date of Patent: Jul. 22, 1986

[54] MUZZLE LOADING APPARATUS

[76] Inventor: John Curtis, 105 Curtis La., Bloomfield, N. Mex. 87413

[21] Appl. No.: 816,426

[22] Filed: Jan. 6, 1986

[51] Int. Cl.[4] ..... F41C 27/00

[52] U.S. Cl. ..... 42/90

[58] Field of Search ..... 42/90; 221/69, 82, 86, 221/91

[56] References Cited

U.S. PATENT DOCUMENTS

| | | | |
|---|---|---|---|
| 11,174 | 6/1854 | Peavey | 42/90 |
| 163,404 | 5/1975 | Phillips | 42/90 |
| 184,079 | 11/1976 | Hovis | 42/90 |
| 243,250 | 6/1981 | Hall | 42/90 |
| 3,747,252 | 7/1973 | Walker | 42/90 |
| 4,050,175 | 9/1977 | Mulinix | 42/90 |
| 4,094,098 | 6/1978 | Gourley | 42/90 |
| 4,112,606 | 9/1978 | Griffin | 42/90 |
| 4,123,868 | 11/1978 | Wilson | 42/90 |
| 4,135,322 | 1/1979 | Tice et al. | 42/90 |
| 4,152,858 | 5/1979 | Dobbs | 42/90 |
| 4,207,698 | 6/1980 | Burson | 42/90 |
| 4,229,897 | 10/1980 | Snowden | 42/90 |
| 4,373,285 | 2/1983 | Grout et al. | 42/90 |
| 4,442,620 | 4/1984 | Drake et al. | 42/90 |
| 4,466,209 | 8/1984 | Strickland et al. | 42/90 |
| 4,550,517 | 11/1985 | Mansfield | 42/90 |

*Primary Examiner*—Charles T. Jordan

*Attorney, Agent, or Firm*—LaValle D. Ptak

[57] ABSTRACT

A device for facilitating the loading of muzzle loading firearms comprises a compact housing having inner and outer concentric hollow cylinders in it. The bottom ends of the cylinders are closed by a slide member which may be selectively moved to a position to open the bottom ends of both cylinders. With the bottom end closed, a measured charge of powder is poured into the outer cylinder. A bullet or ball (with patch, if necessary) is placed in the inner cylinder. A removable cap, having a hole through it which is concentric with the upper opening of the inner cylinder, is placed over the housing to close off the top of the outer cylinder. A ramrod is inserted through the opening in the cap to extend into the inner cylinder and is depressed to place the ball above the movable slide loaded at the bottom. The device subsequently is placed over the end of the barrel of a gun, the slide member is moved to open the bottoms of the cylinders to permit the powder to drop into the barrel. The ramrod then is pushed downwardly to seat the ball in the barrel of the gun or rifle, rapidly loading it.

14 Claims, 11 Drawing Figures

MUZZLE LOADING APPARATUS

BACKGROUND

Muzzle loaded pistols and rifles have been largely supplanted in modern times by more efficient types of firearms. Muzzle loaded firearms, however, continue to enjoy widespread use by large numbers of people for hunting and competitive purposes. One of the primary disadvantageous of muzzle loaded firearms is the relatively long time required to reload the firearm once it has been discharged. Typically the steps for such reloading include first swabbing the barrel to remove the residue from the previously fired shot. Then a measured amount of powder must be poured into the end of the barrel. After the powder has been poured, a patch and bullet are inserted through the end of the barrel and seated on top of the powder by means of a ramrod. These steps, even for a person skilled in the use of such firearms, typically take two or three minutes to accomplish. This time interval for hunting and for timed marksmanship competition is too long.

In addition, unless a receptacle is provided with a premeasured charge of powder, the pouring of powder into the end of the barrel of the firearm from a powder horn or the like produces relatively wide variations in the amount of powder charge from shot to shot. Consequently, the trajectory of the ball varies significantly and inaccuracy of the firearm results.

Various devices have been provided to facilitate the loading of consistent charges of powder into muzzle loaded firearms and to permit such firearms to be more rapidly loaded. Three very old patents to Peavey U.S. Pat. No. 11,174; Phillips U.S. Pat. No. 163,404; and Hovis U.S. Pat. No. 184,079 illustrate attempts at improving the accuracy and speed of reloading muzzle loaded firearms. All of these patents use a rotary magazine having a number of cylindrical chambers in it. Powder is placed in the bottom of each cylinder and the ball is then placed on top of the powder. Rotation of the cylinder in alignment with the barrel of the muzzle loaded rifle, permits the powder to drop through an opening in the device into the barrel. A ramrod then is used to drive the ball and the patch into the barrel on top of the powder.

The devices disclosed in these patents are complicated and have a number of moving parts which require adjustment and which make them relatively bulky in size and expensive to manufacture. In addition, the bulk and difficult operation do not make them particularly practical for field hunting conditions or competitive marksmanship conditions.

A second group of more recent patents, directed to attempts to improve the speed and accuracy of reloading muzzle loaded firearms, includes the patents to Mulinix U.S. Pat. No. 4,050,175; Dobbs U.S. Pat. No. 4,152,858; Snowden U.S. Pat. No. 4,229,897; and Grout U.S. Pat. No. 4,373,285. All four of these patents include a reloading device in which the ball and powder are aligned with one another in the same cylinder. In some of these devices the powder first is poured out from one end of the cylinder and the ball then is driven through the cylinder into the barrel to exit from the same end as the powder. In others, a frangible membrane is placed over the powder at the end of the cylinder. This end then is placed over the end of the rifle and the ball is driven downwardly to cause the powder to break the membrane and flow into the barrel ahead of the ball, which then is forced into the barrel. In Mulinix, when the device is pulled lose as suggested by a downward pull, there is a high probability that some of the powder will be spilled. This subsequently will change the point of impact of the bullet. Since this device has to be turned over there also is a good chance of having a misalignment of the loader with the bore of the firearm.

The device of Snowden is relatively long and bulky and it has a large number of different parts in it. The bulk of this device and the complexity of its use make it impractical for field use.

The Dobbs and Grout patents also are relatively long, since the powder and ball are aligned with one another in the same cylinder. In addition, a frangible membrane must be discarded after each use and replaced. This increases the complexity of use of the device and requires the user to carry an additional supply of frangible membranes, as well as the other elements already necessary for reloading a charge into the barrel of a firearm.

Other reloading devices have been developed which store the powder in one end and the ball in the other end, so that the powder is first poured into the barrel of the firearm from one end, and then is turned over to insert the ball or shot through the other end into the rifle. Devices of this type are subject to the disadvantage of spilling some of the powder. Also, because they must be turned over to insert the ball by means of a ramrod inserted through the end which formerly held the powder, they are relatively slow to use under field conditions.

It is desirable to provide a reloading device for muzzle loading firearms which is compact, accurate, efficient, easy to use under field conditions, and which is not subject to the disadvantages of the prior art devices mentioned above.

SUMMARY OF THE INVENTION

Accordingly it is an object of this invention to provide an improved device for loading muzzle loaded firearms.

It is another object of this invention to provide an improved device for reloading muzzle loaded firearms accurately and quickly under field use conditions.

It is an additional object of this invention to provide a device which permits accurate and trouble-free reloading of muzzle loaded firearms.

It is a further object of this invention to provide a portable reloading device for muzzle loaded firearm which permits accurate and rapid reloading of a previously prepared charge under field conditions of use.

It is yet another object of this invention to provide a muzzle loading device for muzzle loaded firearms which is simple, portable, compact, and easy to use.

In accordance with the preferred embodiment of the invention, a device for facilitating the loading of muzzle loaded firearms includes a housing which has inner and outer concentric cylinders in it. The inner and outer cylinders are open at both their first and second ends. A removable cap engages the top of the housing for closing the first end of the outer cylinder. This cap has a hole through it which is aligned with the first end of the inner cylinder when the cap closes the first end of the outer cylinder. A ramrod is provided for insertion through the hole in the cap to extend into the inner cylinder. A movable slide member is carried by the housing for selectively closing and opening the second end of at least the outer cylinder.

To use the device, a pre-measured charge of powder is poured into the outer cylinder with the cap removed and the slide member closing the outer cylinder. The cap is put in place on the housing and a bullet or ball (including a patch if necessary) is placed in the inner cylinder and pushed by the ramrod to a point just above the movable slide member. The device subsequently then is placed over the muzzle of a firearm, and the slide is moved to open the outer cylinder, which permits the powder to drop into the barrel of the firearm. The ramrod then is fully depressed to seat the ball (and patch) into the barrel of the firearm.

DETAILED DESCRIPTION

Figure 1:
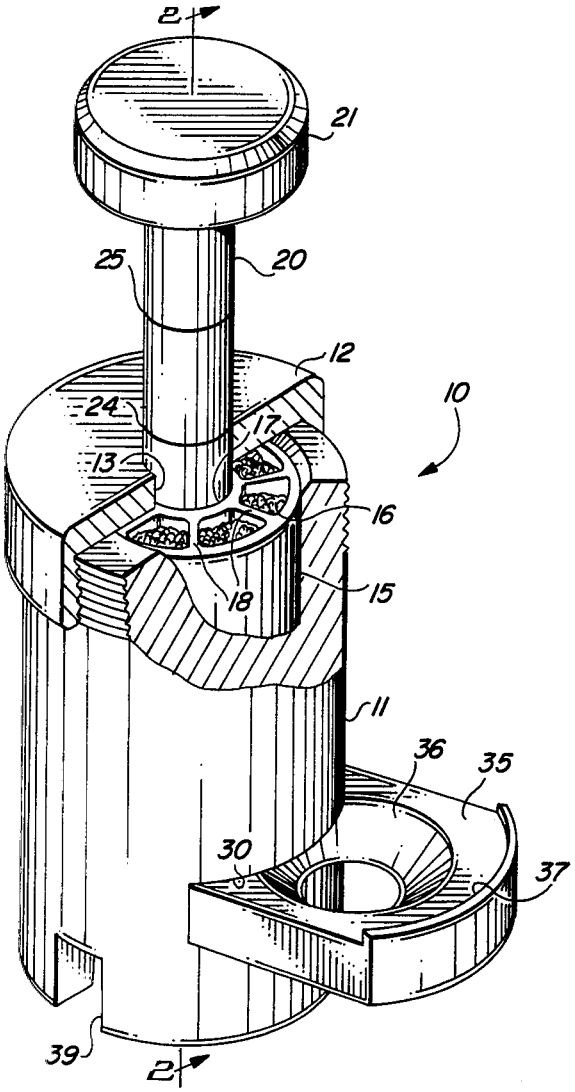
FIG. 1 is a partially cut-away perspective view of a preferred embodiment of the invention.

Reference now should be made to the drawings in which the same reference numbers are used throughout the different Figures to designate the same components. A preferred embodiment of the invention is shown in detail in FIGS. 1, 2 and 3.

The device illustrated in the drawings is for the purpose of providing rapid reloading of muzzle loading, black powder firearms, including caplock or flintlock rifles, shotguns or single shot pistols. In the discussion which follows, the term "bullet" is intended to include cast lead bullets, "minnie balls" and the conventional patch and ball combination.

As illustrated, the reloader device 10 comprises a main body 11 which preferably is cylindrical in shape. The body 11 is open at its bottom end and is closed by a cap 12 at the upper end. As illustrated, the cap 12 is shown as internally threaded to mate with external threads on the upper end of the body 11. Other types of fasteners for the cap 12 to the body 11, however, could be used as well, including, but not limited to, twist-type bayonet fasteners.

Figure 3:
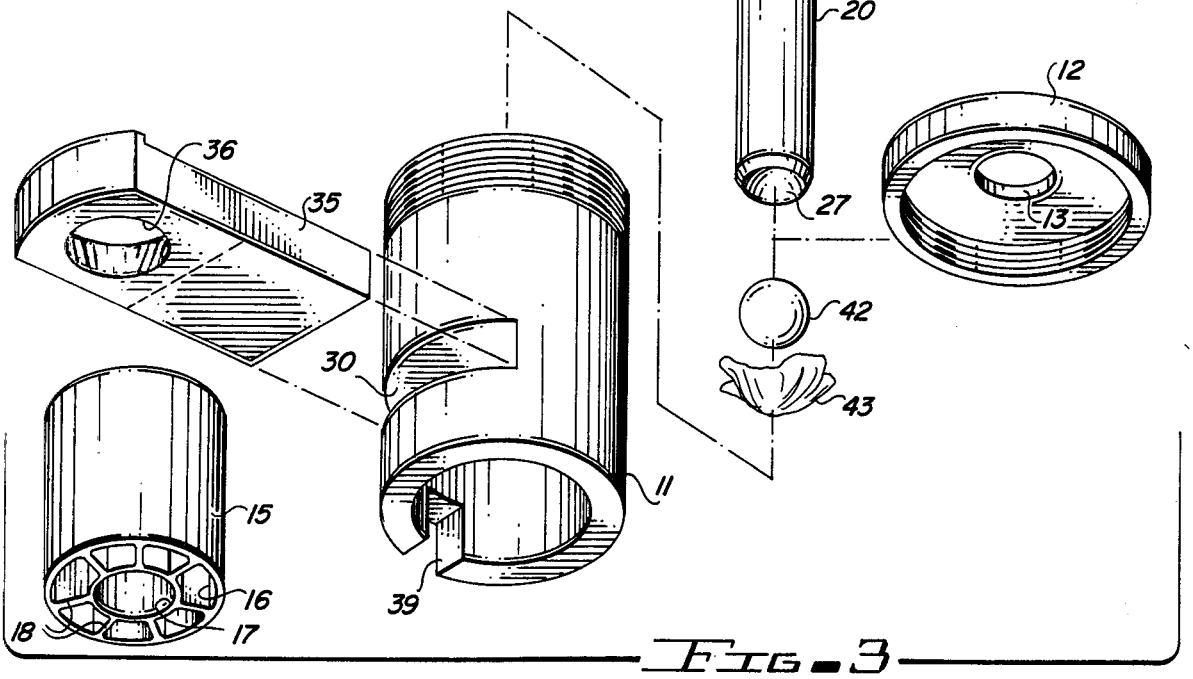
FIG. 3 is an exploded bottom perspective view of the embodiment shown in FIG. 1.

As shown most clearly in FIG. 3, the cap 12 has a circular hole 13 formed through it at its center. The hole 13 is aligned with, and corresponds in diameter to, an inner cylinder 17 of a concentric cylinder insert 15, having an outer cylinder 16 which surrounds the inner cylinder 17. The spacing between the cylinders 16 and 17 is provided by elongated ribs 18. Thus, the concentric cylinder 16 and 17 of the unit 15 may be formed from a suitable plastic through an extrusion process and cut to length for the particular parameters of the reloader device 10.

Figure 2:
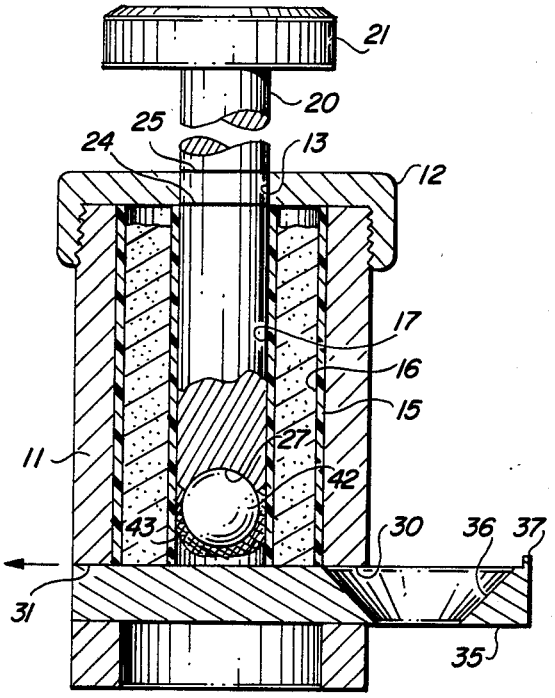
FIG. 2 is a cross-sectional view of the embodiment shown in FIG. 1, taken along the line 2—2 of FIG. 1.

A short ramrod 20, having an external diameter adapted to provide a close frictional fit with the internal diameter of the inner cylinder 17, is provided for inserting a bullet or a ball 42 and patch 43 into the inner cylinder 17 and seating the ball 42 and patch 43 near the bottom of the inner cylinder 17, as illustrated most clearly in FIG. 2. To facilitate the handling of the ramrod 20, a handle 21 is provided on the upper end. The handle 21 may be integrally formed with the ramrod 20 or it may be a separate part attached to the ramrod 20 by means of any suitable fastener. Two circumferential marks 24 and 25 are either scribed into the upper end of the ramrod 20 or are otherwise marked or painted on it. These marks are used by user of the reloader device to accurately position the bullet or ball 42 in the position shown in FIG. 2 when the reloader device is being prepared for subsequent operation.

A pair of oppositely oriented slots 30 and 31 are provided in the main body of the reloader device directly beneath the bottom end of the concentric cylinders 16 and 17. These slots have a width and heighth to accommodate an elongated, rectangularly-shaped, slide member 35 which has a tapered hole 36 formed in one end. The other end of the slide 35 is solid, as shown most clearly in FIGS. 2 and 3. The width of the top of the tapered hole 36 is selected to correspond to the diameter of the outer cylinder 16; but when the slide is in the position shown in FIGS. 1 and 2, the bottom end of the cylinders 16 and 17 both are completely blocked by the slide 35. This is the position of the slide when the device is being prepared for subsequent use and during the time that it is being stored or transported. A raised lip 37 may be provided at the outside edge of the slide 35 to precisely locate the top of the tapered hole 36 in concentric alignment with the cylinders 16 and 17.

Two additional features of the reloader which are illustrated in FIGS. 1, 2, and 3, are the diameter of the internal cylinder of the housing 11 beneath the slide 35 and a notch 39 in the side of the housing 11, open at the bottom and extending into this internal, cylindrical opening. The diameter of the internal opening in the bottom of the housing 11 is chosen to correspond with the external diameter of the barrel of the firearm with which the reloader is to be used. Barrels with different external diameters may require separate reloading devices 11 configured to the specific diameter of the barrel and the bore of the barrel of the firearm. The notch 39 is for the purpose of accommodating the barrel rib or front sight of the firearm so that the reloader device can be placed directly over the end of the barrel in alignment with the bore of the firearm.

Figure 4:
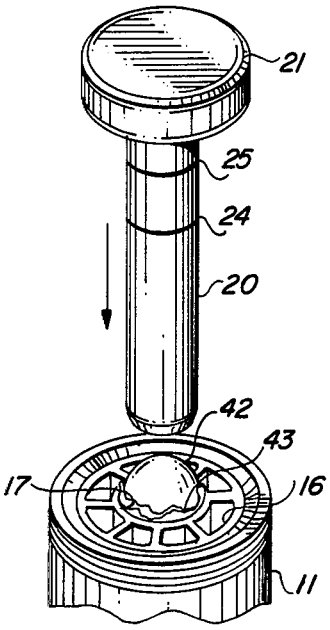
FIGS. 4 through 11 illustrate sequential steps followed in the use of the embodiment of FIG. 1.

Reference now should be made to FIGS. 4 through 11 which illustrate the manner of utilizing the reloader from the initial placement of the bullet and powder in it to the transfer of the powder and bullet to the bore of the firearm. In FIG. 4, the housing 11 is shown with the cap 12 removed. The reloader in this position, is empty; and the slide 35 is pulled outwardly to the right as viewed in FIGS. 1, 2, 7, and 8.

Figure 5:
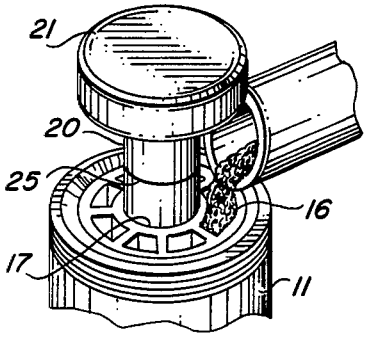

The first step is to place a well lubricated patch 43 over the upper end of the cylinder 17 and place a ball 42 on it. If unpatched, cast bullets are used, the patch 43 may be eliminated and the bullet is placed in the top of the opening of the inner cylinder 17. The diameter of the cylinder 17 relative to the diameter of the patched ball 42 is such that a frictional fit exists between the patched ball and the cylinder which is similar to that which occurs in the bore of the firearm. The concave end 27 of the ramrod plunger 20 then is placed on top of ball 42, and the ramrod plunger 20 is pressed downwardly by pushing on the cap 21 until the line 24 on the ramrod 20 is aligned with the top surface of the cylinder 17. This line 24 causes the patched ball 42 to be located approximately $\frac{1}{8}$" above the upper surface of the slide 35 in the position shown in FIG. 2. This position of the ramrod 20 as viewed by the user is shown in FIG. 5.

With the patched ball 42 in place, and the plunger left in the inner cylinder 17, a predetermined or premeasured amount of powder is poured from a suitable container into the spaces in the outer cylinder 16. This is illustrated in FIG. 5. Once the powder has been poured into the outer cylinder 16, the ramrod 20 is removed. The ball 42 and the patch 43 remain in place held in the cylinder 17 by friction. The cap 12 then is screwed onto the top of the housing 11 to seal off the top of the outer cylinder 16 to confine the powder between the cap 12 and the solid portion of the slide 35 as illustrated in FIG. 2.

Figure 6:
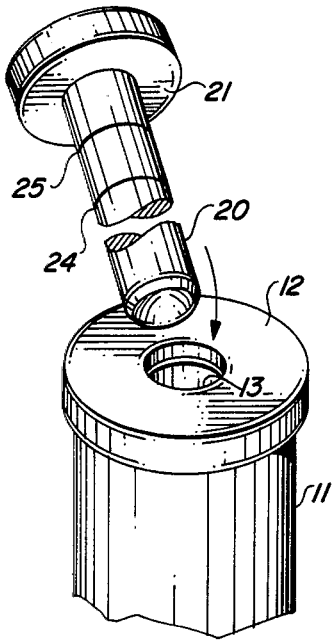

Once the cap 12 is in place, as illustrated in FIG. 6, the ramrod plunger 20 is once again inserted through the hole 13 in the cap 12 and into the inner cylinder 17 until the line 25 on the rod 20 is aligned with the top surface of the cap 12. This is shown most clearly in FIG. 2. It also is apparent from FIG. 2 that when the line 25 is aligned with the top surface of the cap 12, the line 24 also is aligned with the top surface of the cylinders 16 and 17. The line 25 is provided so that the rod 20 can be replaced in the inner cylinder 17 in the same position, resting on top of the ball 42, as it was when the ball was first inserted with the cap 12 removed.

The device now either may be stored or transported with everything in place ready to reload a muzzle loading firearm. The slide 35 and the cap 12, along with the ramrod 20, seal the powder and ball from the external elements; and with proper frictional fits of the various parts, the device can even be made waterproof, which is especially helpful for hunters.

Figure 7:
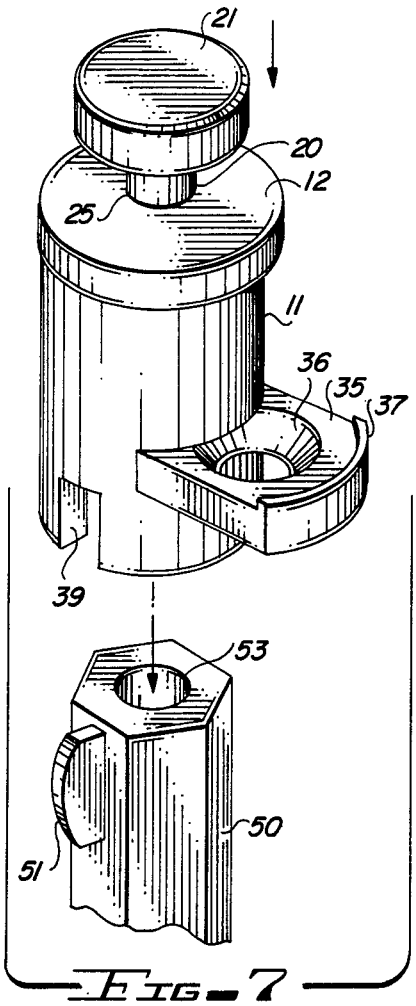
Figure 8:
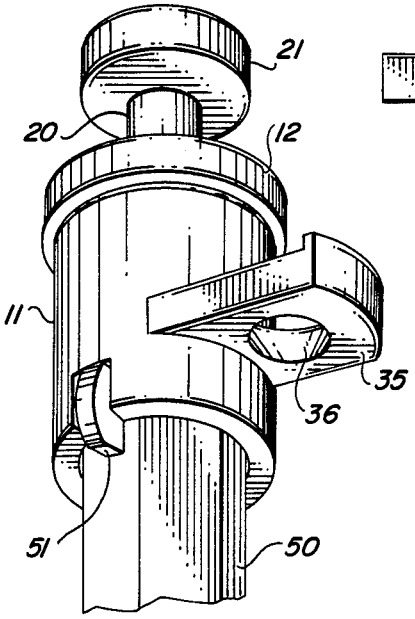

To use the reloader, the bottom of the body 11 is placed over the end of the barrel 50 of a firearm and the slot 39 is aligned with and placed over the barrel rib or front-sight 51 of the firearm. The bore 53 of the firearm with which the reloader is to be used has the same internal diameter as the internal diameter of the inner cylinder 17. Since the internal diameter of the bottom portion of the housing 11 is selected to correspond to the external dimensions of the barrel 50 of the firearm, the cylinder 17 is aligned with the bore 53 of the firearm. FIG. 7 and 8 shown the manner in which the device is placed over and seated onto the end of the barrel of the firearm.

Figure 9:
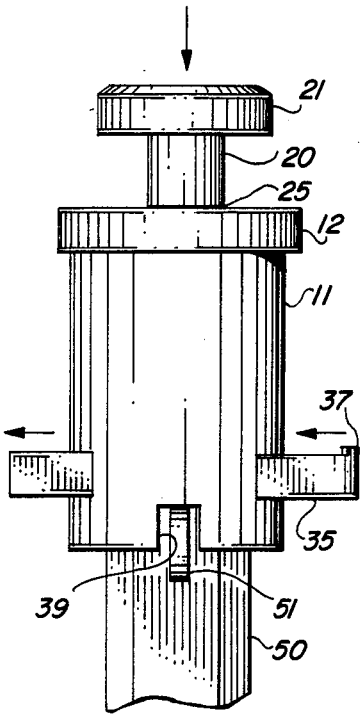
Figure 10:
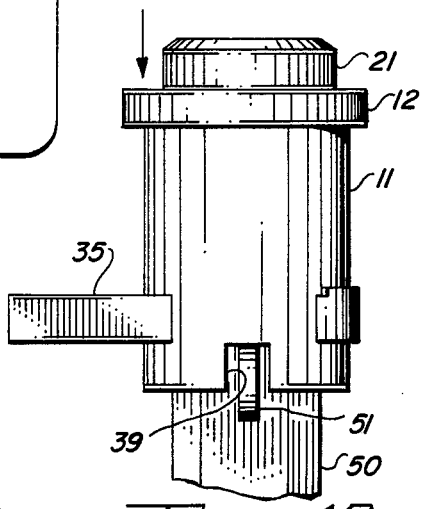
Figure 11:
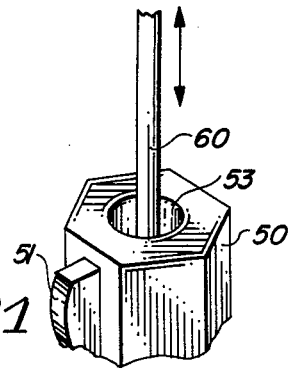

With the device in place as shown in FIG. 8, the slide 35 may be pushed or driven rapidly to the left, as illustrated in FIGS. 9 and 10, to cause the tapered hole 36 to be aligned with the bottom of the cylinder 16. This causes both of the cylinders 16 and 17 to be open to the bore 53 on the end of the barrel. The tapered sides of the opening 36 are provided with as nearly a friction free surface as possible. The powder in the outer cylinder 16 then drops downwardly through the tapered hole 36, the bottom end of which has a diameter equal to the diameter of the bore 53 in the firearm and to the internal diameter of the inner cylinder 17. The powder drops through the hole 36 into the bore 53 of the firearm. A sharp blow then may be struck on the top of the cap 21 to drive it downwardly as shown in FIG. 10 to seat the ball 42 and patch in the bore in the end of the barrel 50.

The device is removed from the end of the firearm, and a standard ramrod 60 is used to seat the ball 42 and patch 43 on top of the powder at the bottom of the barrel 50. A fresh percussion cap then is placed on the nipple and the firearm is ready to shoot. In the case of a flintlock firearm, the pan is primed to complete the ignition step of the reloading cycle sequence.

It should be noted that the powder flows freely by gravity from the powder chamber in the outer cylinder 16 into the bore 53 of the firearm. For field use, a number of reloader devices 10 may be prepared in advance for use and carried by the hunter or marksman to the place of use. This reloader eliminates a number of steps which are normally employed in reloading muzzle loaded firearms and can reduce the time between shots to as low as a 12 to 15 second range.

Various types of materials may be used for the different parts of the reloader. The materials should be selected, however, from catagories which do not produce sparks when they are accidently struck against the barrel or other parts of a firearm or during the movement of the different parts of the reloader device.

The foregoing description has been directed to frictional engagement of the ramrod 20 with the walls of the inner cylinder 17 and of the slide 35 with the slots 30 and 31. It may be necessary, for some applications, to provide additional sealing means or bearings to maintain the parts in the relative positions in which they are placed until the device is ready for use. Such modifications or additions can be accomplished in a number of different conventional ways and for that reason they have not been shown. The notch 39 also could be moved 90° under the slide 35 to accommodate the barrel rib of a rifle and provide a different orientation for use of the device.

Various changes and modifications will occur to those skilled in the art without departing from the scope of the invention. Consequently, the embodiment which has been illustrated in the various figures of the drawings is to be considered illustrative only and not as limiting. For firearms of different calibers, the dimensions of the cylinders and the ramrod 20 must be modified and matched to the bore of the firearm to produce optimum operating results.

I claim:

1. A device for facilitating the loading of muzzle loading firearms including in combination;

a housing having inner and outer concentric cylinders therein, said inner and outer cylinders being open at both the first and second ends thereof;

a removable cap for engagement with one end of said housing for closing the first end of said outer cylinder, said cap having an opening therethrough, said opening aligned with the first end of said inner cylinder when said cap closes said first end of said outer cylinder;

a ramrod for insertion through the opening in said cap for extension into said inner cylinder; and means carried by said housing for selectively closing and opening the second end of at least said outer cylinder.

2. The combination according to claim 1 wherein said inner cylinder is adapted to receive a bullet frictionally engaging said inner cylinder and said outer cylinder is adapted to receive a charge of powder.

3. The combination according to claim 1 wherein said means for closing and opening said second end of said outer cylinder comprises a movable slide means movable to a first position for selectively closing the second end of at least said outer cylinder and movable to a second position opening the second ends of both of said inner and outer cylinders.

4. The combination according to claim 3 wherein said movable slide means is mounted in the housing for movement transversely of the axis of said concentric inner and outer cylinders.

5. The combination according to claim 1 wherein said housing has further means for accommodating the end of the barrel of a firearm for aligning the axis of said concentric inner and outer cylinders with the axis of the bore in the barrel of said firearm.

6. The combination according to claim 3 wherein said outer cylinder is adapted to receive and hold a predetermined charge of powder and said inner cylinder is adapted to receive a bullet; so that with said movable slide means closing the second end of said outer cylinder and with said removable cap in place, powder held in said outer cylinder is contained therein; and movement of said movable slide means to open the second end of said outer cylinder with said housing placed over the barrel of a firearm permits powder contained in said outer cylinder to drop into the barrel of said firearm for subsequent operation of said ramrod to push said bullet through the second end of said inner cylinder into the barrel of said firearm to seat the bullet in the barrel.

7. The combination according to claim 1 wherein said cap threadably engages said one end of said housing.

8. The combination according to claim 7 wherein the opening in said cap is circular and has a diameter equal to the diameter of said inner cylinder.

9. The combination according to claim 8 wherein said means for closing and opening said second end of said outer cylinder comprises a movable slide means movable to a first position for selectively closing the second end of at least said outer cylinder and movable to a second position opening the second ends of both of said inner and outer cylinders.

10. The combination according to claim 9 wherein said movable slide means is mounted in the housing for movement transversely of the axis of said concentric inner and outer cylinders.

11. The combination according to claim 10 wherein said housing has further means for accommodating the end of the barrel of a firearm for aligning the axis of said concentric inner and outer cylinders with the axis of the bore in the barrel of said firearm.

12. The combination of claim 10 wherein said outer cylinder is adapted to receive and hold a predetermined charge of powder and said inner cylinder is adapted to receive a bullet; so that with said movable slide means closing the second end of said outer cylinder and with said removable cap in place, powder held in said outer cylinder is contained therein; and movement of said movable slide means to open the second end of said outer cylinder with said housing placed over the barrel of a firearm permits powder contained in said outer cylinder to drop into the barrel of said gun for subsequent operation of said ramrod to push said bullet through the second end of said inner cylinder into the barrel of said firearm to seat the bullet in the barrel.

13. The combination according to claim 12 wherein said housing has further means for accommodating the end of the barrel of a firearm for aligning the axis of said concentric inner and outer cylinders with the axis of the bore in the barrel of said firearm.

14. The combination according to claim 12 wherein said movable slide means has a tapered opening therethrough with an upper diameter equal to the diameter of said outer cylinder and a lower diameter equal to the diameter of said inner cylinder; and wherein a first position of said movable slide means closes the second ends of both of said inner and outer cylinders, and a second position of said movable slide means opens the second ends of both of said inner and outer cylinders.

* * * * *